US005271499A

United States Patent [19]

Van Horssen

[11] Patent Number: 5,271,499

[45] Date of Patent: Dec. 21, 1993

[54] STORAGE CONTAINER FOR MODEL RAILWAY CARS

[76] Inventor: Charles A. Van Horssen, 9233 N. 12th Ave., Phoenix, Ariz. 85021

[21] Appl. No.: 953,860

[22] Filed: Sep. 30, 1992

[51] Int. Cl.[5] ..... B65D 85/30; B65D 85/68

[52] U.S. Cl. ..... 206/335; 206/523; 206/587

[58] Field of Search ..... 206/319, 349, 335, 523, 206/524, 587, 591

[56] References Cited

U.S. PATENT DOCUMENTS 2,282,908 5/1942 Thompson ..... 206/523
4,101,031 7/1978 Cromie ..... 206/523 X
4,240,240 12/1980 Cohen ..... 206/523 X
4,433,781 2/1984 Hummel ..... 206/349 X
4,754,880 7/1988 Tehrani ..... 206/523

*Primary Examiner*—Steven N. Meyers
*Assistant Examiner*—Jacob K. Ackun, Jr.
*Attorney, Agent, or Firm*—Tod R. Nissle

[57] ABSTRACT

A storage container for model railroad cars includes a pair of spaced apart foam cushions on the top and bottom of the container. The cushions compress and secure the railroad cars in fixed position in the storage container. The cushions are cut from a single piece of foam material.

3 Claims, 2 Drawing Sheets

STORAGE CONTAINER FOR MODEL RAILWAY CARS

BACKGROUND OF THE INVENTION

1. Field of the Invention

This invention relates to storage containers.

More particularly, the invention relates to a storage container for model railroad cars, the container including a pair of spaced apart foam cushions on the top and bottom of the container which compress and secure the railroad cars in fixed position between the cushions in the storage container.

In a further respect, the invention relates to a storage container of the type described in which the foam cushions are cut from a single piece of foam material.

2. Description of the Prior Art

Containers for packing tops and various other material are well known in the art. See, for example U.S. Pat. Nos. 4,185,739 to Wilford, 4,353,464 to Bentler, 2,860,768 to Smithers, and 4,964,509 to Insley etal. None of such prior art devices appear to be very well adapted to storing model railroad cars or similar articles.

Accordingly, it would be highly desirable to provide an improved storage container which was adapted to retain and transport model railroad cars and similar articles and which minimized the wastage of materials in constructing the container.

Therefore, it is a principal object of the invent to provide an improved storage container.

A further object of the invention is to provide an improved storage container including a top and a bottom and including opposed resilient cushion material mounted on top and bottom.

Another object of the invention is to provide an improved storage container of the type described in which the cushion material is cut from a single piece of material.

BRIEF DESCRIPTION OF THE DRAWINGS

These and other, further and more specific objects and advantages of the invention will be apparent to those skilled in the art from the following detailed description thereof, taken in conjunction with the drawings, in which.

SUMMARY OF THE INVENTION

Briefly, in accordance with the invention, I provide an improved storage container. The container includes a box having a bottom, a pair of spaced apart opposing end walls attached to and upwardly extending from the bottom; a front wall attached to and upwardly extending from the bottom; a back wall attached to and upwardly extending from the bottom; and, a top pivotally attached to the back wall and having an underside. The top is movable between at least two operative positions, a first operative position with the top closed and generally parallel to the bottom, and a second operative position with the top open. The storage container includes cushion means including a primary cushion member and at least one secondary cushion member. The primary cushion member extends over the bottom of the box and includes an elongate U-shaped groove formed therein. The groove includes a floor and a pair of spaced apart surfaces extending outwardly from the floor and the bottom. At least one of the spaced apart surfaces slopes away from the floor. The secondary cushion member is secured to the underside of the top such that the secondary cushion member extends over the U-shaped groove when the top is in the second operative position. The secondary cushion member conforms to the U-shaped groove and is cut from the primary cushion member to form the U-shaped groove therein.

DESCRIPTION OF THE PREFERRED EMBODIMENT(S)

Figure 1:
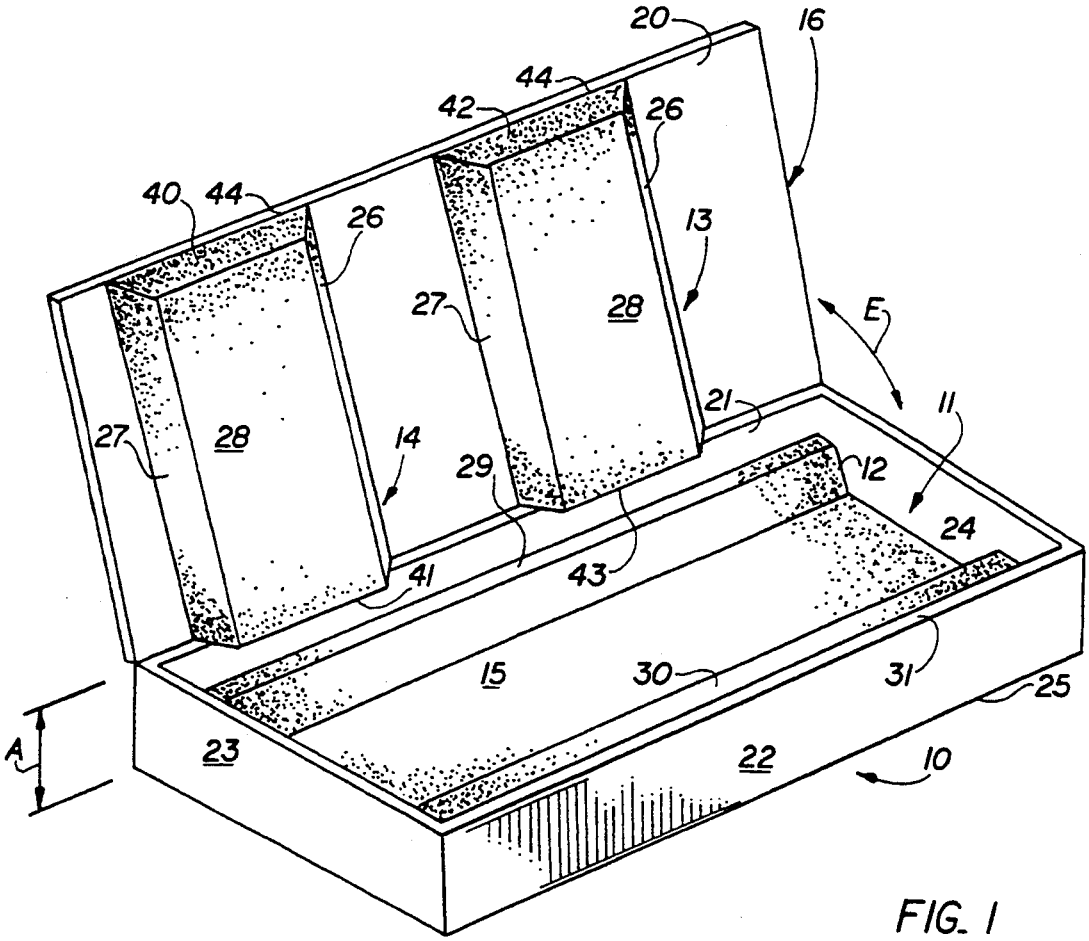
FIG. 1 is a perspective view of a storage container constructed in accordance with the principles of the invention; and, FIG. 2 is a section view of the storage container illustrating the mode of operation thereof.
Figure 2:
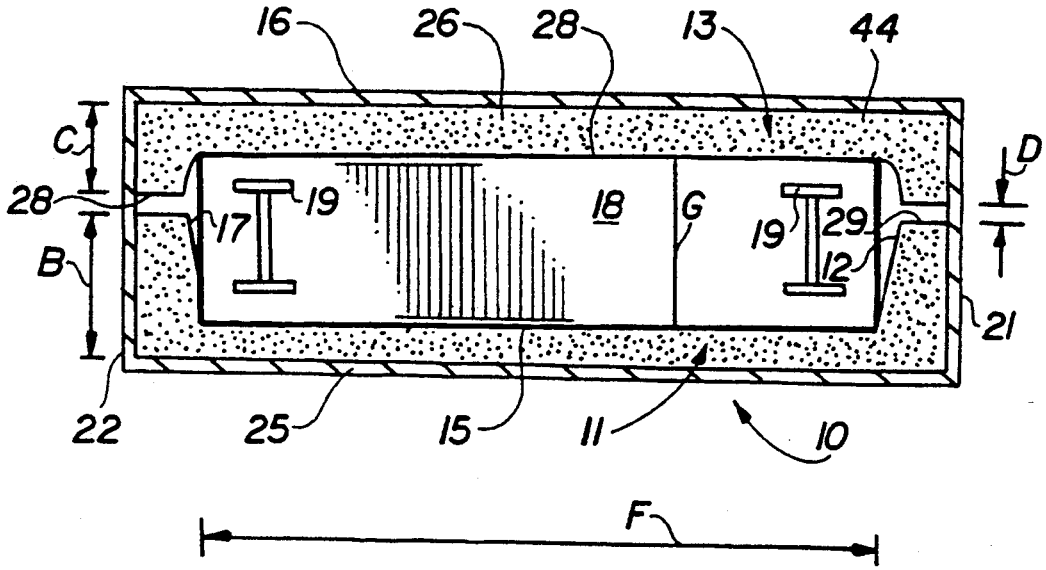

Turning now to the drawings, which depict the presently preferred embodiment of the invention for the purpose of illustrating the practice thereof, and not by way of limitation of the scope of the invention, and in which like reference characters refer to corresponding elements throughout the several views, FIGS. 1 and 2 illustrate a storage container for model trains or similar articles. The container includes a rectangular bottom panel 25, spaced apart opposing parallel side panels 23 and 24 attached to and upwardly extending from bottom panel 25, front wall panel 22 attached to and extending upwardly from bottom panel 25, back wall panel 21 attached to and upwardly extending from bottom panel 25, and top panel 16. Top panel 16 is pivotally attached to the upper edge of back wall panel 21 to pivot in the directions indicated by arrows E in FIG. 1. Panel 16 can be pivoted between at least two operative positions, the open position illustrated in FIG. 1 and the closed position illustrated in FIG. 2. In the closed operative position the distal or outermost edge of panel 16 contacts the lip 31 of front wall panel 22.

U-shaped primary cushion member 11 fits in the storage container in the manner illustrated in FIGS. 1 and 2. The elongate U-shaped groove in cushion member 11 includes a rectangular floor 15, a pair of spaced apart canted surfaces 12 and 17 extending outwardly from floor 15 and bottom panel 25 and sloping away from floor 15. Secondary cushion members 13 and 14 are attached to the underside 20 of top panel 16 with adhesive or other means. Each member 13 and 14 includes rectangular contact surface 28 and opposed elongate canted surface 26 and 27. Members 13 and 14 are, as illustrated in FIGS. 1 and 2, adhered to underside 20 such that when top panel 16 is in the closed position of FIG. 2, members 13 and 14 extend transversely of the floor 15 and the U-shaped groove formed in cushion member 11. Member 13 and/or 14 can, if desired, be at any angle with respect to the U-shaped groove in member 11. Members 13 and/or 14 can also be adhered to underside 20 in an orientation generally parallel to the U-shaped groove in member 11. It is critical that members 13 and/or 14, regardless of whether they are canted with respect to or parallel to the U-shaped groove in member, extend over the groove to contact a train or other device stored in the groove when the top panel 16 of the storage container is closed in the manner illustrated in FIG. 2.

Resilient, compressible cushion member 11 and members 13 and 14 are obtained by taking a rectangular prism piece of resilient, compressible cushion material and cutting a U-shaped groove in the material to obtain member 11 and members 13 and 14. The volume, V, of a rectangular prism equals $(a)\times(b)\times(c)$, where a=length
b=width
c=depth In other words, members 13 and 14 comprise the material that is cut from the rectangular prism piece of cushion material to form member 11. Ordinarily, when members 13 and 14 are cut from the rectangular prism piece of cushion material, members 13 and 14 are interconnected and form one long unitary piece of material which is cut in half to obtain members 13 and 14. If, in FIG. 1, members 13 and 14 are detached from underside 20 and are placed end-to-end in the U-shaped groove in member 11, then surfaces 26 of members 13 and 14 contact and conform to surface 17; surfaces 27 of members 13 and 14 contact and conform to surface 12; surfaces 28 contact and conform to surface 15; trapezoid ends 41 and 42 contact; trapezoid end 40 contacts end wall panel 23; trapezoid end 42 contacts end wall panel 24; and, rectangular back surfaces 44 of members 13 and 14 are coplanar with one another and with rectangular surfaces 29 and 30. When members 13 and 14 are placed end-to-end in the U-shaped groove in member 11 in this manner, surfaces 28 jointly define a rectangular surface having a shape and dimension generally equivalent to, but larger than, that of floor 15; surfaces 26 jointly define a canted rectangular surface having a shape and dimension generally equivalent to that of surface 17; and surfaces 27 jointly define a canted rectangular surface having a shape and dimension generally equivalent to that of surface 12.

It is preferred that the height, indicated by arrows B in FIG. 2, of cushion member 11 be about one-half or less of the depth or height, indicated by arrows A in FIG. 1, of the storage container so that members 13 and 14 (which were cut out to form the U-shaped groove of member 11) will, when secured to underside 20, be spaced a distance indicated by arrows D (FIG. 2) apart from member 11 when to panel 16 is in the closed position of FIG. 2. It is important that surface 28 not contact surfaces 29 and 30 so that the compressive forces generated by members 11, 13 and 14 act against a model railway car 18 and not against each other. The height B of member 11 can be greater than one-half of the depth A of the storage container as long as when members 13 and 14 are fabricated and attached to the underside 20, members 13 and 14 do not bear against member 11 when panel 16 is in the closed position of FIG. 2.

The height, indicated by arrows C in FIG. 2, of each member 13 and 14 (in their normal uncompressed state) equals the depth of the U-shaped groove formed in member 11 (when member 11 is in its normal uncompressed state), which is why back surfaces 44 are coplanar with surfaces 29 and 30 when members 13 and 14 are placed in and conform to the U-shaped groove in member 11.

In use, a model railway car, like the model box car 18 shown in FIG. 2, is placed transversely in the U-shaped groove formed in member 11. The width, indicated by arrows F in FIG. 2, of the U-shaped groove is slightly less than the length of car 18 so that when car 18 is seated against floor 15, then ends of car 18 partial outwardly compress at least portions of canted surfaces 12 and 17. When resilient surfaces 12 and 17 are compressed, outward "spring" forces are generated by surfaces 12 and 17 against the ends of car 18. Such spring forces help "hold" car 18 in position in the U-shaped groove. Further, when top wall panel 16 is in the closed position shown in FIG. 2, surface 28 and floor 15 are each compressed because the width G of the model railway car is greater than the distance between parallel surfaces 28 and 15 when panel 16 is in the closed positions. Consequently, surfaces 28 and 15 also generate outward "spring" forces which act against the sides of car 18 and function to retain car 18 in position between surface 15 and 28.

Having described my invention in such terms as to enable those skilled in the art to understand and practice it, and having identified the presently preferred embodiments thereof, I claim:

1. In combination with a model railway car including a top, a bottom, a pair of sides, a pair of ends, and wheels attached to the bottom, a storage container for protecting and transporting the model railway car laid on a side of the railway car in the container, the storage container including (a) a box having
  (i) a bottom,
  (ii) a pair of spaced apart opposing end walls attached to and upwardly extending from said bottom,
  (iii) a front wall attached to and upwardly extending from said bottom,
  (iv) a back wall attached to and upwardly extending from said bottom, and
  (v) a closed top attached to said back wall, having an underside, and generally parallel to said bottom; and (b) resilient cushion means to secure the railway car laid on a side of the railway car in the container, said cushion means including
  (i) a primary cushion member (11) extending over and contacting said bottom of said box and including an outer surface (29,30) and an elongate U-shaped groove formed in said outer surface, said groove including a resiliently compressed floor (15) contacting and supporting one side of the railway car (18) and including a pair of resiliently compressed spaced apart surfaces extending outwardly from said floor and each contacting and generating a compressive force against one end of the railway car, and
  (ii) at least one secondary cushion member (13,14) secured to said underside of said top of said box such that said secondary cushion member extends over said U-shaped groove and is spaced apart from said primary cushion member, said secondary cushion member conforming to said U-shaped groove and being cut from said primary cushion member to form said U-shaped groove therein, said secondary cushion member including a resiliently compressed surface (28) opposing said floor of said U-shaped groove and contacting and generating a compressive force against the other side of the railway car to press said one side of the railway car against said floor; said bottom and wheels of said railway car generally being positioned intermediate said floor and said compressed surface (28) of said secondary cushion member without
    contacting said floor (15) and said compressed surface (28) of said secondary cushion, and
    being subjected to compressive forces acting normal to said bottom and parallel both to said floor and said compressed surface of said secondary cushion member.

2. A storage and transport assembly for a model train including, in combination, (a) a model railway car including a top, a bottom, a plurality of wheels attached to the bottom, first and second opposing spaced apart sides, and first and second opposing spaced apart ends;

(b) a box having (i) a bottom, (ii) a pair of spaced apart opposing end walls (23,24) attached to and upwardly extending a selected distance (A) from said bottom and having upper edges spaced apart from said bottom, (iii) a front wall attached to and upwardly extending from said bottom, (iv) a back wall attached to an upwardly extending from said bottom, and (v) a closed top attached to said back wall, having an underside, and being generally parallel to said bottom and adjacent said upper edges of said end walls; and, (c) resilient cushion means contacting said railway car to secure said railway car in said box, said cushion means including (i) a primary cushion member (11) extending over and contacting said bottom of said box, having a height (B) equal to or less than about one-half of said selected distance, having an outer surface (29,30), and including an elongate U-shape groove formed in said outer surface and extending across said bottom, said groove including a resiliently compressed floor (15) contacting and supporting said first side of the railway car and including a pair of resiliently compressed spaced apart surfaces extending outwardly from said floor and each contacting and generating a compressive force against one of said ends of said railway car, at least one of said surfaces sloping away from said floor, and (ii) at least one secondary cushion member (13,14) secured to said underside of said top of said box such that said secondary cushion member extends over said U-shaped groove and is spaced apart from said primary cushion member, said secondary cushion member being cut from said outer surface of said primary cushion member to form said U-shaped groove therein, said secondary cushion member including a resiliently compressed surface (28) opposing said floor of said U-shaped groove and contacting and generating a compressive force against said second side of said railway car, said second side of said railway car being positioned above and outside of said U-shaped groove and above and spaced apart from said outer surface of said primary cushion member said bottom and said wheels of said railway car generally being positioned intermediate said floor and said compressed surface of said secondary cushion member with contacting said compressed surface of said secondary cushion member and said floor, and being subjected to compressive forces acting normal to said bottom and parallel to said floor and said compressed surface of said secondary cushion member;

said assembly securing said railway car during transport by simultaneously compressing said sides and ends of said railway care with said cushion means.

3. A storage and transport assembly for a model train including, in combination, (a) a model railway car including a top, a bottom, a plurality of wheels attached to the bottom, first and second opposing spaced apart sides, and first and second opposing spaced apart ends;

(b) a box having, (i) a bottom, (ii) a pair of spaced apart opposing end walls (23,24) attached to and upwardly extending from said bottom and having upper edges spaced apart from said bottom, (iii) a front wall attached to and upwardly extending from said bottom, (iv) a back wall attached to and upwardly extending from said bottom, and (v) a closed top attached to said back wall, having an underside, and being generally parallel to said bottom and adjacent said upper edges of said end walls; and, (c) resilient cushion means contacting said railway car to secure said railway car in said box, said cushion means including (i) a primary cushion member (11) extending over and contacting said bottom of said box, having an outer surface (29,30), and including an elongate U-shaped groove formed in said outer surface and extending across said bottom, said groove including a resiliently compressed floor (15) contacting and supporting said first side of the railway car and including a pair of resiliently compressed spaced apart surfaces extending outwardly from said floor and each contacting and generating a compressive force against one of said ends of said railway car, at least one of said surfaces sloping away from said floor, and (ii) at least one secondary cushion member (13,14) secured to said underside of said top of said box such that said secondary cushion member extends over said U-shaped groove and is spaced apart from said primary cushion member, said secondary cushion member being cut from said outer surface of said primary cushion member to form said U-shaped groove therein, said secondary cushion member including a resiliently compressed surface (28) opposing said floor of said U-shaped groove and contacting and generating a compressive force against said second side of said railway car, said second side of said railway car being positioned above and outside of said U-shaped groove and above said outer surface of said primary cushion member;

said bottom and said wheels of said railway car generally being positioned intermediate said floor and said compressed surface of said secondary cushion member without contacting said compressed surface of said secondary cushion member and said floor, and being subjected to compressive forces acting normal to said bottom and parallel to said floor and said compressed surface of said secondary cushion member;

said assembly securing said railway car during transport by simultaneously compressing said sides and ends of said railway care with said cushion means.

* * * * *